US006098038A

United States Patent [19]

Hermansky et al.

[11] Patent Number: 6,098,038

[45] **Date of Patent: *Aug. 1, 2000**

[54] METHOD AND SYSTEM FOR ADAPTIVE SPEECH ENHANCEMENT USING FREQUENCY SPECIFIC SIGNAL-TO-NOISE RATIO ESTIMATES

[75] Inventors: Hynek Hermansky, Banks; Carlos M. Avendano, Hillsboro, both of Oreg.

[73] Assignee: Oregon Graduate Institute of Science & Technology, Beaverton, Oreg.

[ * ] Notice: This patent issued on a continued prosecution application filed under 37 CFR 1.53(d), and is subject to the twenty year patent term provisions of 35 U.S.C. 154(a)(2).

[21] Appl. No.: 08/722,547

[22] Filed: Sep. 27, 1996

[51] Int. Cl.[7] ..... G10L 3/02

[52] U.S. Cl. ..... 704/226

[58] Field of Search ..... 704/201, 224, 704/225, 226, 227, 228

[56] References Cited

U.S. PATENT DOCUMENTS

| | | | |
|---|---|---|---|
| 3,803,357 | 4/1974 | Sacks . | |
| 4,052,559 | 10/1977 | Paul et al. . | |
| 4,177,430 | 12/1979 | Paul | 455/306 |
| 4,630,305 | 12/1986 | Borth et al. | 381/94.3 |
| 4,658,426 | 4/1987 | Chabries et al. | 381/94.3 |
| 4,737,976 | 4/1988 | Borth et al. . | |
| 4,761,829 | 8/1988 | Lynk, Jr. et al. | 455/307 |
| 4,799,179 | 1/1989 | Masson et al. | 364/724.1 |
| 4,811,404 | 3/1989 | Vilmur et al. | 381/94.3 |
| 4,937,873 | 6/1990 | McAulay et al. . | |
| 4,942,607 | 7/1990 | Schoder et al. . | |
| 5,008,939 | 4/1991 | Bose et al. . | |
| 5,012,519 | 4/1991 | Adlersberg et al. | 704/226 |
| 5,148,488 | 9/1992 | Chen et al. | 704/219 |
| 5,214,708 | 5/1993 | McEachern . | |
| 5,253,298 | 10/1993 | Parker et al. . | |
| 5,285,165 | 2/1994 | Renfors et al. | 327/552 |
| 5,355,431 | 10/1994 | Kane et al. . | |
| 5,432,859 | 7/1995 | Yang et al. . | |
| 5,434,947 | 7/1995 | Gerson et al. | 704/219 |
| 5,450,522 | 9/1995 | Hermansky et al. . | |
| 5,485,524 | 1/1996 | Kuusama et al. . | |
| 5,524,148 | 6/1996 | Allen et al. . | |
| 5,577,161 | 11/1996 | Ferrigno | 704/226 |
| 5,590,241 | 12/1996 | Park et al. | 704/227 |

OTHER PUBLICATIONS

M. Sambur, "Adaptive Noise Canceling For Speech Signals," *IEEE Trans. ASSP*, vol. 26, No. 5, pp. 419–423, Oct., 1978.

Y. Ephraim and H.L. Van Trees, "A Signal Subspace Approach For Speech Enhancement," *IEEE Proc. ICASSP*, vol. II, pp. 355–358, 1993.

Y. Ephraim and H.L. Van Trees, "A Spectrally–Based Signal Subspace Approach For Speech Enhancement," *IEEE ICASSP Proceedings*, pp. 804–807, 1995.

S. F. Boll, "Suppression Of Acoustic Noise In Speech Using Spectral Subtraction," *Proc. IEEE ASSP*, vol. 27, No. 2, pp. 113–120, Apr., 1979.

(List continued on next page.)

*Primary Examiner*—David R. Hudspeth
*Assistant Examiner*—Michael N. Opsasnick
*Attorney, Agent, or Firm*—Brooks & Kushman P.C.

[57] ABSTRACT

A method and system for adaptively filtering a speech signal in order to suppress noise in the signal. The method includes decomposing the signal into multiple frequency subbands, each having a center frequency, estimating a signal-to-noise ratio for each subband, and providing multiple filters, each filter designed for one of a number of selected signal-to-noise ratio independent of the center frequencies of the subbands. The method also includes selecting a filter for filtering each subband, where the filter selected depends on the signal-to-noise ratio estimated for the subband, filtering each subband according to the filter selected, and combining the filtered subbands to provide an estimated filtered speech signal. The system includes appropriate hardware and software for performing the method.

18 Claims, 2 Drawing Sheets

OTHER PUBLICATIONS

G.S. Kang and L.J. Fransen, "Quality Improvement of LPC–Processed Noisy Speech By Using Spectral Subtraction, " *IEEE Trans. ASSP*37:6, pp. 939–942, Jun. 1989.

M. Viberg and B. Ottersten, "Sensor Array Processing Based On Subspace Fitting," *IEEE Trans. ASSP*, 39:5, pp. 1110–1121, May, 1991.

L. L. Scharf, "The SVD And Reduced–Rank Signal Processing," *Signal Processing* 25, pp. 113–133, Nov., 1991.

H. Hermansky and N. Morgan, "RASTA Processing Of Speech," *IEEE Trans. Speech And Audio Proc.*, 2:4, pp. 578–589, Oct., 1994.

H. Hermansky, E.A. Wan and C. Avendano, "Speech Enhancement Based On Temporal Processing," *IEEE ICASSP Conference Proceedings*, pp. 405–408, Detroit, MI, 1995.

D. L. Wang and J. S. Lim, "The Unimportance Of Phase In Speech Enhancement," *IEEE Trans. ASSP*, vol. ASSP–30, No. 4, pp. 679–681, Aug. 1982.

H. G. Hirsch, "Estimation Of Noise Spectrum And Its Application To SNR–Estimation And Speech Enhancement,", *Technical Report*, pp. 1–32, Intern'l Computer Science Institute.

A. Kundu, "Motion Estimation By Image Content Matching And Application To Video Processing," to be published *ICASSP, 1996*, Atlanta, GA.

Harris Drucker, "Speech Processing In A High Ambient Noise Environment," *IEEE Trans. Audio and Electroacoustics*, vol. 16, No. 2, pp. 165–168, Jun., 1968.

John B. Allen, "Short Term Spectral Analysis, Synthesis, and Modification by Discrete Fourier Transf.", IEEE Tr. on Acc., Spe. & Signal Proc ., vol. ASSP–25, No. 3, Jun. 1977.

"Signal Estimation from Modified Short–Time Fourier Transform," IEEE Trans. on Accou. Speech and Signal Processing , Vo. ASSP–32, No. 2, Apr., 1984.

Simon Haykin, "Neural Works —A Comprehensive Foundation," 1994.

K. Sam Shanmugan, "Random Signals: Detection, Estimation and Data Analysis," 1988.

H. Kwakernaak, R. Sivan, and R. Strijbos, "Modern Signals and Systems," pp. 314 and 531, 1991.

METHOD AND SYSTEM FOR ADAPTIVE SPEECH ENHANCEMENT USING FREQUENCY SPECIFIC SIGNAL-TO-NOISE RATIO ESTIMATES

CROSS-REFERENCE TO RELATED APPLICATIONS

This application is related to U.S. patent application Ser. Nos. 08/496,068 and 08/695,097, filed on Jun. 28, 1995 and Aug. 7, 1996, respectively.

TECHNICAL FIELD

This invention relates to an adaptive method and system for filtering speech signals based on frequency-specific signal-to-noise ratio estimates.

BACKGROUND ART

One of the most recent and profitable applications in the telecommunications industry, mobile telephony has now reached a stage where it is widely available to the public. As a result, the quality of such mobile telephony services is of special concern for companies seeking to remain competitive in the market.

In that regard, mobile telephone calls frequently originate from noisy environments. Prior art noise suppression systems, such as that discussed in an article by Hermansky et al. entitled "Speech Enhancement Based On Temporal Processing", *IEEE ICASSP Conference Proceedings,* pp. 405–408, Detroit, Mich., 1995, disclose speech enhancement techniques for suppressing such noise in which compressed time trajectories of power spectral components of short-time spectrum of corrupted speech are processed by a filter bank with finite impulse response (FIR) filters designed on parallel recordings of clean and noisy data.

However, the "background noise" in mobile communications described above generally exhibits characteristics which change from one call to the next. In contrast, the prior art noise suppression techniques described above are noise-specific. As a result, such techniques are most efficient on disturbances similar to those present in the training data.

Thus, there exists a need for an improved speech enhancement method and system. Such a method and system would use a priori knowledge concerning speech temporal properties under different noise conditions so that only an estimate of the noise level would be required to effectively enhance a speech signal. In contrast to the prior art, such a speech enhancement method and system would thus provide for adaptive filtering by accounting for the noise variations present in mobile communications.

DISCLOSURE OF THE INVENTION

Accordingly, it is the principle object of the present invention to provide an improved method and system for filtering speech signals.

According to the present invention, then, a method and system are provided for adaptively filtering a speech signal to suppress noise therein. The method comprises decomposing the speech signal into a plurality of frequency subbands, each subband having a center frequency, estimating a signal-to-noise ratio for each subband, and providing a plurality of filters, each filter designed for a one of a plurality of selected signal-to-noise ratios independent of the center frequencies of the plurality of subbands. The method further comprises selecting one of a plurality of filters for each subband, wherein the filter selected depends on the signal-to-noise ratio estimated for the subband, filtering each subband according to the filter selected, and combining the filtered subbands to provide an enhanced speech signal.

The system of the present invention for adaptively filtering a speech signal to suppress noise therein comprises means for decomposing the speech signal into a plurality of frequency subbands, each subband having a center frequency, means for estimating a signal-to-noise ratio for each subband, and a plurality of filters for filtering the subbands, each filter designed for a one of a plurality of selected signal-to-noise ratios independent of the center frequencies of the plurality of subbands. The system further comprises means for selecting one of the plurality of filters for each subband, wherein the filter selected depends on the signal-to-noise ratio estimated for the subband, and means for combining the filtered subbands to provide an enhanced speech signal.

These and other objects, features and advantages will be readily apparent upon consideration of the following detailed description in conjunction with the accompanying drawings.

BEST MODE FOR CARRYING OUT THE INVENTION

In the prior art noise suppression techniques described above, it has been observed that the magnitude frequency response of filters corresponding to frequency regions of high speech energy showed suppression of low (<2 Hz) and high (>8 Hz) modulation frequencies, while enhancing modulations around 5 Hz. (As used herein, the term modulation frequency describes the frequency content of the time trajectories of the subband magnitude outputs of the short-time Fourier transform, using 8 kHz sampling, 256 samples per window, and 75% window overlap.) Filters at regions of low spectral energy were low-pass or had flat response.

Moreover, the dc gain of the filters was high at high signal-to-noise ratio (SNR) subbands and low at low SNR subbands, thus following the Wiener principle of optimal noise suppression. Such observations suggest that filter characteristics depend on the energy of the speech signal relative to the noise level at each subband. As a result, a filter bank can be designed based on these local SNRs (frequency-specific SNRs).

In general, then, the method and system of the present invention provide an adaptive speech enhancement technique based on processing of the temporal trajectories of the short-time spectrum of speech. The method and system select a set of pre-computed filters to process the compressed short-time power spectral trajectories of noisy speech. Filter selection is based on the estimated signal-to-noise ratio at each frequency subband. Responses of the precomputed filters depend only on the estimated signal-to-noise ratios (SNRs) and not on the center frequency of the subbands.

The set of pre-computed filters is designed using parallel recordings of noisy and clean speech over several signal-to-noise ratios. In the preferred embodiment of the present invention, the filters used are 200 ms long finite impulse response filters (FIR) which are applied to the cubic-root compressed trajectories of the short-time power spectrum. After filtering, the signal is resynthesized by an overlap-add technique where the unmodified noisy short-time phase is used.

Figures 1A, 1B, 1C:
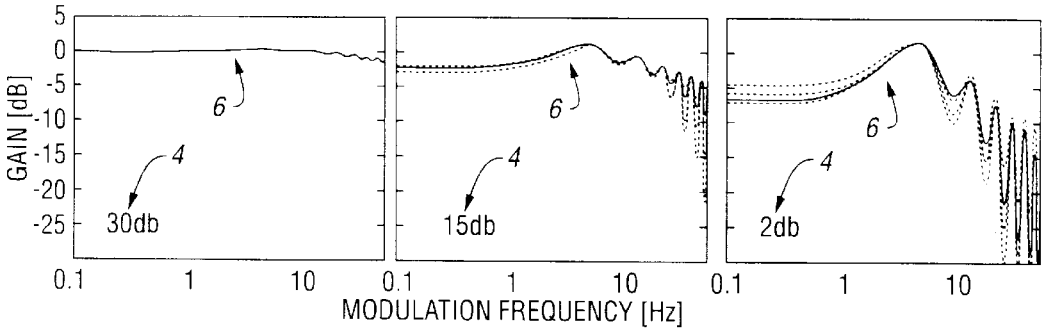
FIGS. 1*a–f* are graphical representations of frequency responses and a mean response for several signal-to-noise ratio specific filters according to the method and system of the present invention.
Figures 1D, 1E, 1F:
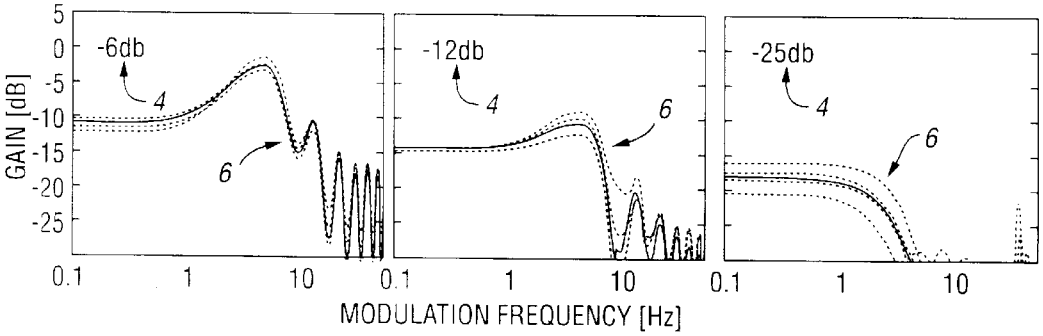
Figure 2:
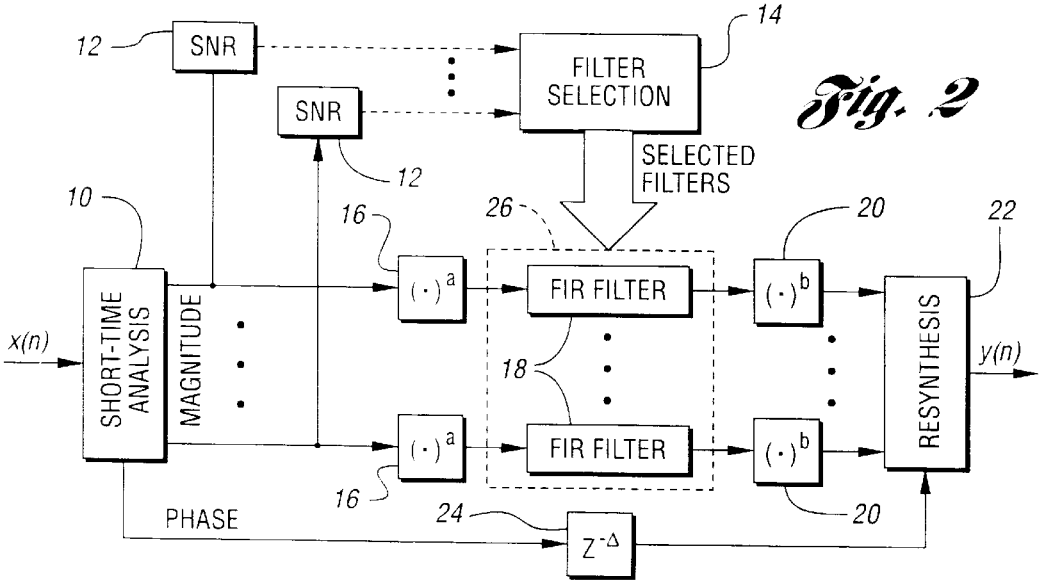
FIG. 2 is a block diagram of the adaptive speech enhancement method and system of the present invention.

With reference to FIGS. 1 and 2, the preferred embodiment of the present invention will now be described in detail. Referring first to FIG. 1, graphical representations of frequency responses and a mean response for several exemplary signal-to-noise ratio specific filters according to the method and system of the present invention are shown. As seen therein, such plots demonstrate that the filter responses depend only on the local SNR (4), rather than also depending on the center frequency of the subband for which they are designed.

In that regard, the plots of FIG. 1 were developed using a database constructed by corrupting a sample of clean speech (approximately 180 second in length, taken from the TIMIT database) with additive white Gaussian noise (AWGN) at different overall SNRs of 30, 20, 15, 10, 5, 3, 2, 0, −2, −5, −7, −10, −12, −15 and −25 dB. From this training data a set of filter banks were designed (one for each overall SNR (4) condition) following the procedure described above. Thus, the exact frequency-specific SNR for the data used to design each filter in the filter banks was known. This frequency-specific SNR (4) was computed as the ratio of the total power of the time trajectories of the magnitude short-time Fourier transform (STFT) of speech and noise signal at the given frequency band.

As previously stated, FIG. 1 shows the filter characteristics for several exemplary subband SNRs (4). More specifically, each plot shows the magnitude frequency responses of filters derived at a given SNR (4) for several frequency subbands (dotted lines), together with the mean response (solid line) (6) of the filters. It should be noted that filters were computed for a given frequency-specific SNR (4) only at some representative subbands covering the frequency range of interest.

As seen therein, as the frequency-specific SNR (4) decreases, the magnitude frequency response of the filters changes from a flat response (i.e., no filtering—see FIG. 1*a*), through a strong bandpass response enhancing modulation frequencies around 5 Hz (i.e., speech enhancement—see FIGS. 1*c* and 1*d*), to a low gain, low cut-off frequency low-pass response (i.e., suppression of the given component—see FIG. 1*f*) It should also be noted that the attenuation of the dc component increases with the decreasing frequency-specific SNR (4). Such results confirm that the filters are strongly dependent on the SNR (4) of the subband and are relatively independent of the subband center frequency.

Based on such results, a speech enhancement system may be designed which adapts to a specific noise condition. This adaptability makes the system applicable in realistic situations where noises and speech of unknown variance and coloration are experienced, such as in mobile communications.

Figure 3:
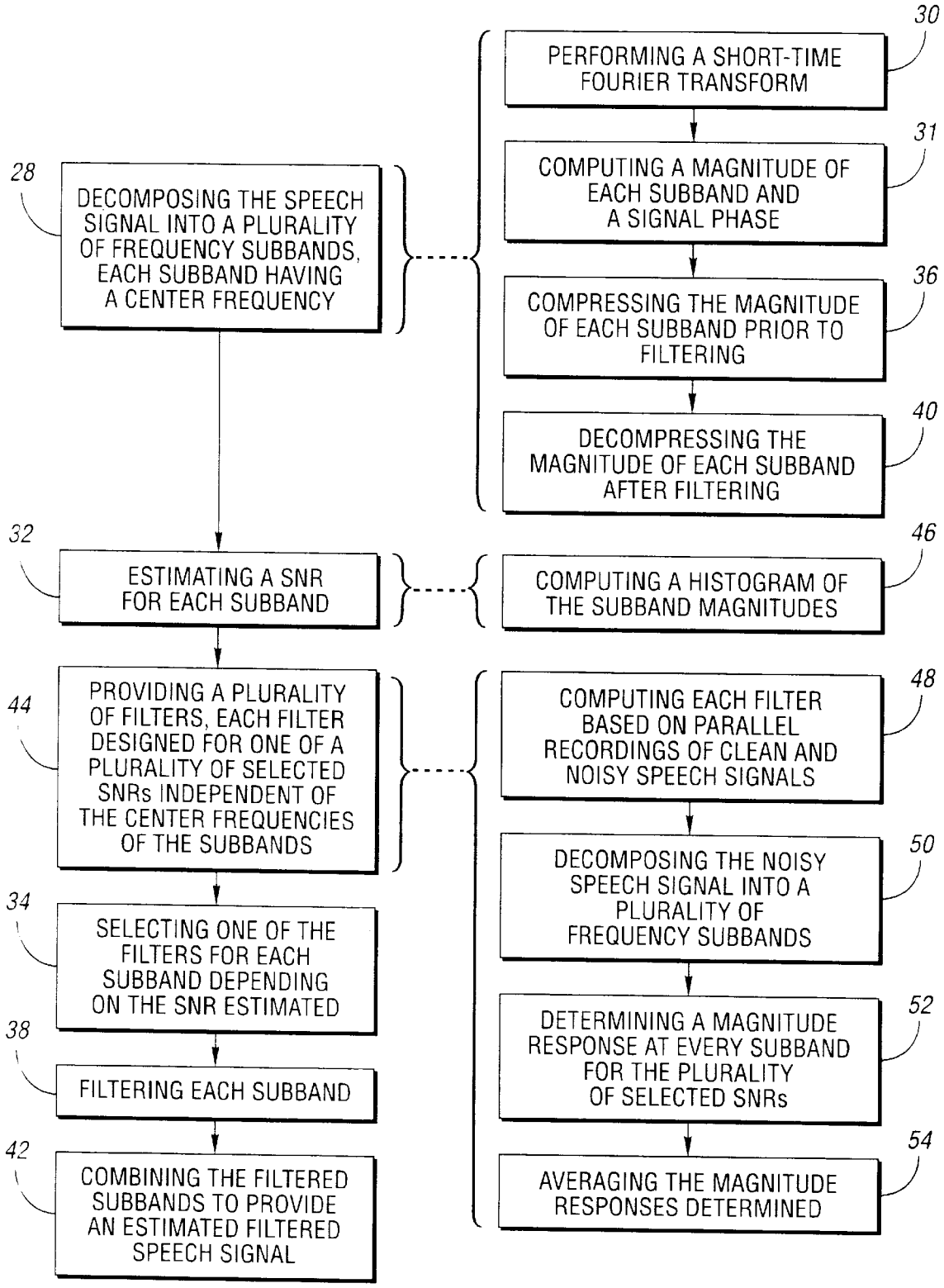
FIG. 3 is a flowchart of the adaptive speech enhancement method of the present invention.

Referring now to FIGS. 2 and 3, a block diagram and a flowchart of the speech enhancement method and system of the present invention are shown. As seen therein, to assemble the appropriate filter bank for a particular corrupted (i.e., noisy) input speech sample, x(n), the sample is first decomposed (10, 28) using STFT analysis (30, 31). Thereafter, the frequency-specific SNR is computed (12, 32) for each resulting magnitude STFT time trajectory. Based on the frequency-specific SNR computed (12, 32), a filter is selected (14, 34) from a basis set of a few precomputed basic filter shapes. After a filter has been selected (34) for each subband, each magnitude STFT trajectory is compressed (16), filtered (18, 38) according to the filter selected as described above, expanded (20, 40), and resynthesized (22, 42) to provide an estimate of a clean (enhanced) speech signal, y(n).

In that regard, as seen in FIGS. 2 and 3, for the purposes of compression (36) and expansion (40) of the magnitude STFT trajectories, a=⅔ and b=¼. Moreover, resynthesis (22, 42) is accomplished via an overlap-add technique which uses the original phase of the corrupted input speech signal, x(n), delayed by phase delayer (24) in order to compensate for the group delay introduced by filtering (18). It should also be noted that the filters (18) selected for each magnitude STFT trajectory subband together comprise a filter bank (26, 44). It should further be noted, as those of ordinary skill in the art will recognize, that the system for performing the method of the present invention is computer based, and may include hardware and/or appropriate software as means for performing the functions described herein.

In practice, however, frequency-specific SNRs are not known. As a result, an estimation procedure is required. In that regard, the internal consistency of the estimate as a measure of its usefulness for selecting a set of filters is of primary interest, rather than the accuracy of the SNR estimates themselves.

For this purpose, a known noise estimation procedure may be applied, such as that disclosed in an article by Hirsch entitled "Estimation Of Noise Spectrum And Its Application To SNR Estimation And Speech Enhancement", *Technical Report TR*-93-012, International Computer Science Institute, Berkeley, Calif., 1993. In such procedures, the noise power at each magnitude STFT trajectory is estimated by computing a histogram (46) of its amplitudes. The peak of the smoothed histogram is chosen as the noise amplitude estimate. Since the power of the clean speech signal is unknown, the power of the available noisy signal is used, thus obtaining an estimate of the noisy signal-to-noise ratio. In the method and system of the present invention, the performance of such an estimator is acceptable.

To derive the set of basic filters, the same clean and noisy data described above may be used (48). In that regard, it is assumed that the additive noise sources of interest have Gaussian distributions. The coloration of the noise is irrelevant given that, individually, the subband noise components from a colored Gaussian noise signal behave in the same way as if they were derived from a white source.

To derive a set of SNR-specific filters, the magnitude frequency responses (50, 52) of filters computed at a given SNR are averaged (54) [(6)—See FIG. 1], and a non-causal linear phase FIR filter is designed from such an averaged response. In that regard, filters with center frequencies below 100 Hz are excluded from the averaged response because no reliable speech signal is available in mobile telephone speech at low frequencies, and their responses were found to deviate slightly from the average (mainly in the dc gain factor). Moreover, the linear phase assumption is justified from the observation that all the filters computed as described above are approximately linear phase. In the method and system of the present invention, a total of 25 filters, each corresponding to a frequency-specific SNR in 1 dB steps, is preferred.

In order to calibrate the SNR estimator which is used during processing (i.e. to find a mapping between the estimated and actual frequency-specific SNRs), the SNRs corresponding to each filter may be estimated using the histogram technique. The filters are stored in a table along with their corresponding frequency-specific SNRs. During the operation of the speech enhancement system on data with unknown noise, the SNR is estimated for each subband and a proper filter bank is built by selecting those filters from the table whose frequency-specific SNRs are closest to the estimated values.

To demonstrate the improved quality of speech filtering provided by the present invention, clean speech artificially corrupted with colored Gaussian noise may be processed with prior knowledge of the frequency-specific SNR. The results of such processing indicate a strong suppression of background noise while preserving the speech signal with very minor distortions. The residual noise has a very different character than the original disturbance. While the noise is not musical as in spectral subtraction, it presents periodic level fluctuations. These fluctuations are related to the enhancement of certain modulation frequencies imposed by the filters in the medium SNR range (see FIG. 1). The modulation frequencies of the residual noise around 5 Hz are also enhanced and can be heard as the periodic disturbance.

Applying the method and system of the present invention to that same speech sample (i.e., using the frequency-specific SNR estimates), very similar results are obtained. In that regard, the primary differences are an underestimation of the noise level and slightly milder suppression. These differences may be addressed by tuning the estimated to real SNR map, or biasing the SNR estimator itself.

Thus, the method and system of the present invention provide noticeable suppression of perceived noise over a wide range of noise types and levels present in real cellular telephone calls. In that regard, qualitative testing of the method and system of the present invention has demonstrated a general agreement among subjects concerning the reduction of background noise and preservation of the speech signal.

While the speech enhancement method and system of the present invention are generally directed to adaptive noise suppression in applications such as voice mail where noisy speech recordings are available for non-real-time processing, they are not limited to such applications. With some modifications, the method and system are also suitable for real-time processing. In that regard, the frequency-specific SNR estimation procedure can be done in real-time if a first estimate is computed during the first few seconds of a conversation and updated over the length of the sample. As such, the method and system of the present invention have the ability to adapt to time-varying conditions.

As is readily apparent from the foregoing description, then, the present invention provides an improved method and system for filtering speech signals. More specifically, the present invention provides a method and system which account for the noise variations present in mobile communications through the use of an estimate of the noise level. In such a fashion, the method and system of the present invention provide a more compact design. Moreover, in contrast to the prior art, the speech enhancement method and system of the present invention provides for adaptive filtering of speech signals for noise suppression.

While the present invention has been described herein in conjunction with mobile communications, those of ordinary skill in the art will recognize its utility in any application where noise suppression in a speech signal is desired. Those of ordinary skill in the art will further recognize that SNR is an indicator of speech quality and, as described herein, is used to develop an estimate of speech quality. As a result, while SNR as described herein is preferred, other indicators and/or techniques for estimating speech quality may also be employed.

Thus, it is to be understood that the present invention has been described in an illustrative manner and that the terminology which has been used is intended to be in the nature of words of description rather than of limitation. As previously stated, many modifications and variations of the present invention are possible in light of the above teachings. Therefore, it is also to be understood that, within the scope of the following claims, the invention may be practiced otherwise than as specifically described herein.

We claim:

1. A method for adaptively filtering a speech signal to suppress noise therein, the method comprising:

decomposing the speech signal into a plurality of frequency subbands, each subband having a center frequency;

estimating a signal-to-noise ratio for each subband;

providing a plurality of filters, each filter designed for one of a plurality of selected signal-to-noise ratios independent of the center frequencies of the plurality of subbands;

selecting one of the plurality of filters for each subband, wherein the filter selected depends on the signal-to-noise ratio estimated for the subband;

filtering each subband according to the filter selected; and combining the filtered subbands to provide an estimated filtered speech signal.

2. The method of claim 1 wherein decomposing the signal into a plurality of frequency subbands comprises performing a short-time Fourier transform on the signal.

3. The method of claim 2 wherein decomposing the signal into a plurality of frequency subbands further comprises computing a magnitude of each subband and a signal phase.

4. The method of claim 3 wherein estimating a signal-to-noise ratio for each subband comprises computing a histogram of the subband magnitudes.

5. The method of claim 1 wherein providing a plurality of filters comprises computing each filter based on parallel recordings of a clean speech signal and a noisy speech signal.

6. The method of claim 5 wherein providing a plurality of filters comprises:

decomposing the noisy speech signal into a plurality of frequency subbands;

determining a magnitude response at every subband for the plurality of selected signal-to-noise ratios; and averaging the magnitude responses determined for each one of the plurality of selected signal-to-noise ratios.

7. The method of claim 6 wherein each of the plurality of filters comprises a finite impulse response filter.

8. The method of claim 7 wherein the plurality of filters comprises a filter bank.

9. The method of claim 3 further comprising:

compressing the magnitude of each subband prior to filtering; and de-compressing the magnitude of each subband after filtering.

10. A system for adaptively filtering a speech signal to suppress noise therein, the system comprising:

means for decomposing the speech signal into a plurality of frequency subbands, each subband having a center frequency;

means for estimating a signal-to-noise ratio for each subband;

a plurality of filters for filtering the subbands, each filter designed for one of a plurality of selected signal-to-noise ratios independent of the center frequencies of the plurality of subband;

means for selecting one of the plurality of filters for each subband, wherein the filter selected depends on the signal-to-noise ratio estimated for the subband; and means for combining the filtered subbands to provide an estimated filtered speech signal.

11. The system of claim 10 wherein the means for decomposing the signal into a plurality of frequency subbands comprises means for performing a short-time Fourier transform on the signal.

12. The system of claim 11 wherein the means for decomposing the signal into a plurality of frequency subbands further comprises means for computing a magnitude of each subband and a signal phase.

13. The system of claim 12 wherein the means for estimating a signal-to-noise ratio for each subband comprises means for computing a histogram of the subband magnitudes.

14. The system of claim 10 further comprising means for computing the plurality of filters based on parallel recordings of a clean speech signal and a noisy speech signal.

15. The system of claim 14 wherein the means for computing the plurality of filters comprises:

means for decomposing the noisy speech signal into a plurality of frequency subbands;

means for determining a magnitude response at every subband for the plurality of selected signal-to-noise ratios; and means for averaging the magnitude responses determined for each one of the plurality of selected signal-to-noise ratios.

16. The system of claim 15 wherein each of the plurality of filters comprises a finite impulse response filter.

17. The system of claim 16 wherein the plurality of filters comprises a filter bank.

18. The system of claim 12 further comprising:

means for compressing the magnitude of each subband prior to filtering; and means for de-compressing the magnitude of each subband after filtering.

* * * * *